US006135674A

United States Patent [19]

Neilson

[11] Patent Number: 6,135,674

[45] Date of Patent: Oct. 24, 2000

[54] ROOF BOLT STORAGE/TRANSPORT APPARATUS

[75] Inventor: Brad Neilson, New South Wales, Australia

[73] Assignee: Cram Australia Pty Ltd., Dapto, Australia

[21] Appl. No.: 09/141,736

[22] Filed: Aug. 27, 1998

[30] Foreign Application Priority Data

Aug. 28, 1997 [AU] Australia ..... PO8830
Aug. 28, 1997 [AU] Australia ..... PO8831

[51] Int. Cl.[7] ..... E21D 20/00

[52] U.S. Cl. ..... 405/259.1; 405/259.6; 405/288; 405/303; 211/70

[58] Field of Search ..... 405/259.1, 259.5, 405/259.6, 288, 303; 211/70.4, 70

[56] References Cited

U.S. PATENT DOCUMENTS 4,215,953 8/1980 Perraud ..... 405/303
4,226,559 10/1980 Prebensen ..... 405/303
4,229,124 10/1980 Frey et al. ..... 405/303
4,398,850 8/1983 Talvensaari ..... 405/259.6
4,420,277 12/1983 Hibbard et al. ..... 405/303 X
4,832,536 5/1989 Spross et al. ..... 405/303
5,114,279 5/1992 Bjerngren et al. ..... 405/303
5,165,825 11/1992 Wallin ..... 405/303
5,556,235 9/1996 Morrison et al. ..... 405/303
5,597,267 1/1997 Morrison et al. ..... 405/303

*Primary Examiner*—Eileen D. Lillis
*Assistant Examiner*—Tara L. Mayo
*Attorney, Agent, or Firm*—James Earl Lowe, Jr.

[57] ABSTRACT

A rod storage and transport apparatus comprising a roof bolter including a tool. The apparatus includes a rotatable holding carousel adjacent the tool and adapted to hold a plurality of rods therein. The apparatus also includes an extending and retracting transport mechanism cooperating with the carousel to move one rod at a time between the carousel and the tool, so that the tool can use the one rod to perform a mine operation. The carousel has a generally elongated shape and is able to rotate about a longitudinal axis of the shape. This permits the carousel to position the one rod held by the carousel adjacent the transport mechanism, so that the transport mechanism can transport the one rod to the tool, or position the carousel to receive a rod transported by the transport mechanism from the tool. The transport mechanism when fully retracted is substantially within a cylinder generated by the rotation of one of the rods about the longitudinal axis of the carousel.

26 Claims, 9 Drawing Sheets

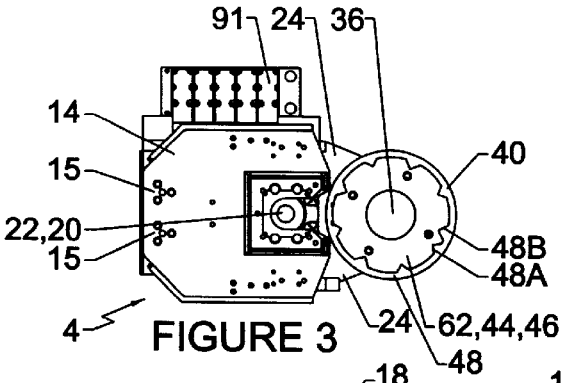
FIGURE 3
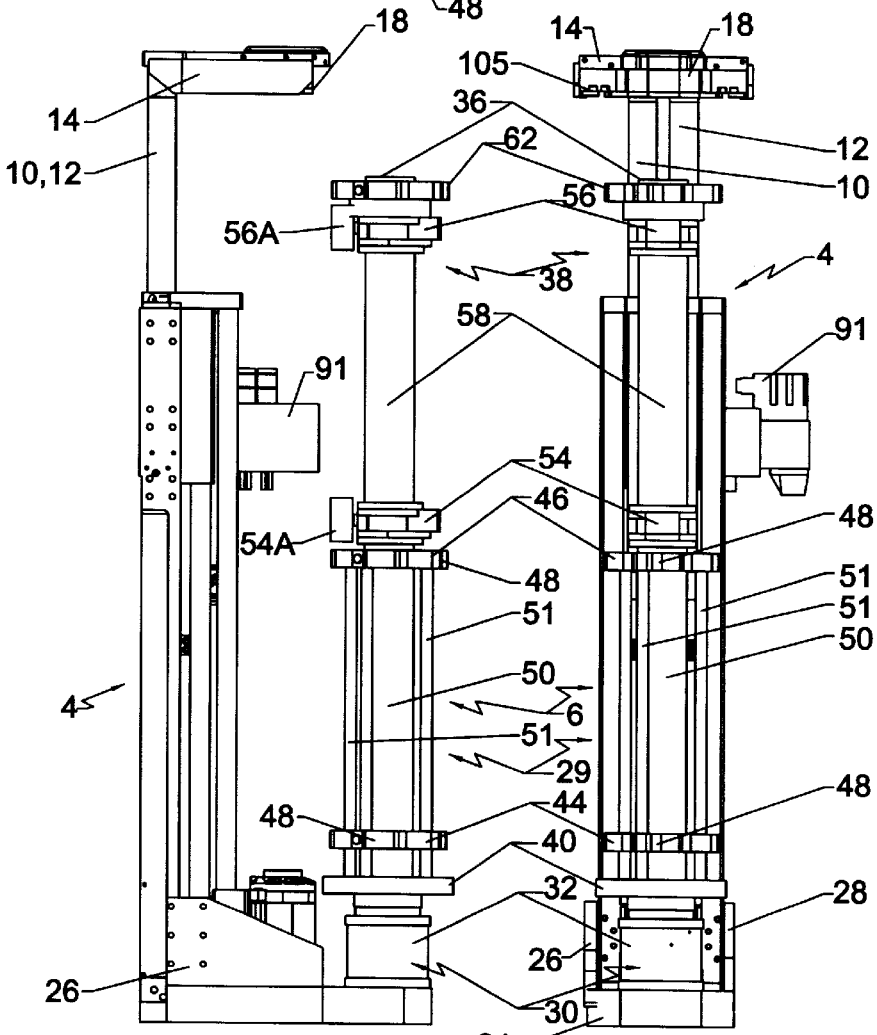
FIGURE 4
FIGURE 5
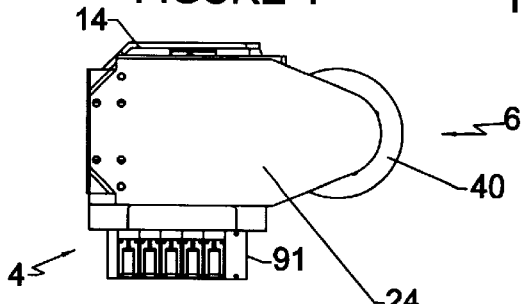
FIGURE 6

ROOF BOLT STORAGE/TRANSPORT APPARATUS

FIELD OF THE INVENTION

The present invention relates to roof bolters and or drilling apparatus, as well as to improvements in storage and transport apparatus for use therewith.

BACKGROUND OF THE INVENTION

The trend in mining and mining equipment supplies is to reduce the numbers of mine workers needed to operate equipment and perform tasks, and at the same time increase productivity. In many equipment areas of mining operations this is being achieved. However, to date, the automation of roof bolting has been relatively slow due to particular complications and difficulties which are peculiar to the roof bolting process.

One reason for this is that the roof bolting process involves some seven different steps as follows:

A. Drilling:

1. loading drill steel into the rotational drive or drilling unit;
2. drilling a rock surface;
3. removing drill steel from the rotational drive or drilling unit;

B. Chemical Anchor:

4. loading chemical anchor into the bored hole into a formation to be anchored;

C. Roof Bolting:

5. loading a roof bolt into the rotational drive or drilling unit;
6. rotating the roof bolts so as to mix and thus set the chemical anchor;
7. once chemical anchor has been secured, tightening the nut on the roof bolt to thereby finalise the roof bolting process.

Whilst there are at least seven steps in the process, the difficulty has been to replicate the actions of humans who attend to these seven steps.

One major difficulty has been replicating the actions of humans to load drill steels and roof bolts into the rotational drive or drilling units. A second major difficulty is the installation of the anchor chemicals into the bored surface of a formation to be anchored.

One attempt to solve these problems is disclosed in U.S. Pat. No. 4,229,124, published on Oct. 21, 1998. Disclosed in U.S. Pat. No. 4,229,124 is an automatic roof bolting system having a powered rotational drilling unit, a rotatable storage unit for resin; a powered rotational roof bolt installer; and a rotatable storage units to dispense roof bolts.

U.S. Pat. No. 4,229,124 has several disadvantages. One disadvantage is that two of the four components must be able to be lined up with a hole drilled by the drilling unit in circumstances which do not lend themselves to precise work. A second disadvantage is the need to provide two drive units which is expensive, requires additional controls and adds weight. For the system of U.S. Pat. No. 4,229,124 to operate, the four units must be able to rotate around a pivot, so as to align the drill unit, resin storage unit and roof bolt installer with the bore once it is drilled. Another difficulty with the system disclosed in U.S. Pat. No. 4,229,124 is that the use of the four units results in a very large footprint. Such a large footprint, together with a double sized footprint (to allow for rotation about the pivot) makes the system somewhat unsuitable for applications where multiple roof bolters are to work in the confined space of a mine entry.

It is an object of the present invention to ameliorate, at least in part, at least one disadvantages of the prior art.

SUMMARY OF THE INVENTION

The present invention provides a rod storage and transport apparatus having:

a rotatable holding means to hold a plurality of rods therein, a transport means cooperating with said holding means to move one rod at a time between said holding means and a tool which will use said rod to perform a mine operation, said holding means having a generally elongated shape and being able to rotate about a longitudinal axis of said shape so as to position one rod held by said holding means adjacent said transport means so that said transport means can transport said rod to said tool or position said holding means to receive a rod transported by said transport means from said tool;

said transport means when fully retracted being substantially within a cylinder generated by the rotation of one of said rods about said longitudinal axis of said holding means.

The invention further provides a carousel for use with a tool for performing a mining operation, said carousel including a carriage unit mounted on a rotation means and being able to rotate to position at least one rod held in said carriage unit so as to cooperate with at least one transport means, said carousel including an axis of rotation for said rod located substantially parallel to the axis of said tool along which or around which said rod will rotate or move, said rod being held in and transported by said carousel so that said rod is oriented in the same direction as is required for use in said tool, said carousel including a first shaft to which is secured said at least one transport means, said first shaft being stationary relative to said tool and a second shaft rotatable relative to said first shaft and said tool, said second shaft having mounted thereon at least one holding means to receive said rod.

The invention also provides a chemical anchor deployment apparatus comprising an open tubular member closable at one end by a moveable plug, said member once plugged receiving at least one compound for installation in a pre-drilled bore in a formation to be secured, said at least one compound being forced out of said member by application of force to said plug along a substantial length of said member.

The invention further provides a mechanised centraliser for use with a drilling or roof bolting tool, said centraliser having in one condition a generally U-shaped bight in one end thereof to receive a rod, said centraliser closing said bight once said rod has travelled into said bight whereby said rod is held in a longitudinal axis which is coincident or collinear with a central rotation or translation axis of a drive unit of said drilling unit or said roof bolter.

BRIEF DESCRIPTION OF THE DRAWINGS

An embodiment of the present invention will now be described by way of example only, with reference to the accompanying drawings in which:

FIG. 3 illustrates a plan view of the apparatus of FIG. 1;

FIG. 4 illustrates a left side elevation of the apparatus of FIG. 1;

FIG. 5 illustrates a front elevation of the apparatus of FIG. 1;

FIG. 6 illustrates an underneath view of the apparatus of FIG. 1;

DETAILED DESCRIPTION OF THE EMBODIMENTS

Throughout this specification the word "rod" or "rods" refers to any one of a roof bolt, drill steel, drill rod, coring tubes or rods, or chemical anchor tube or equipment which may be used in a mine process or operation, which equipment will generally have a generally elongated cylindrical shape.

Throughout this specification the words "roof bolt" and derivations of these words are taken to include other strata stabilisation articles and other similar named bolting articles such as rock bolts, anchor bolts, anchor tendons, tendons and any other similar articles which can be used for any purpose including drilling and bolting of ribs, floors, walls and faces of mines and any other location requiring strata stabilisation.

The expression "roof bolter" when used in this specification and claims means an apparatus able to be predominantly used for roof bolting processes, but is also able to be used exclusively for drilling or coring purposes, without any actual installation of roof bolts. In which latter case the drilling unit, timber jack component and other components are simply used for drilling and or coring purposes alone.

In general terms the present inventions are embodied in an automateable roof bolting apparatus generally referred to by the numeral 2 in FIGS. 1 to 7.

The following description will refer to roof bolting apparatus for the purpose of example only as the invention is applicable to other mining apparatus such as drilling machines and apparatus. Such drilling machines and apparatus may have similar or different structures and forms as the roof bolting apparatus described herein.

Figure 7:
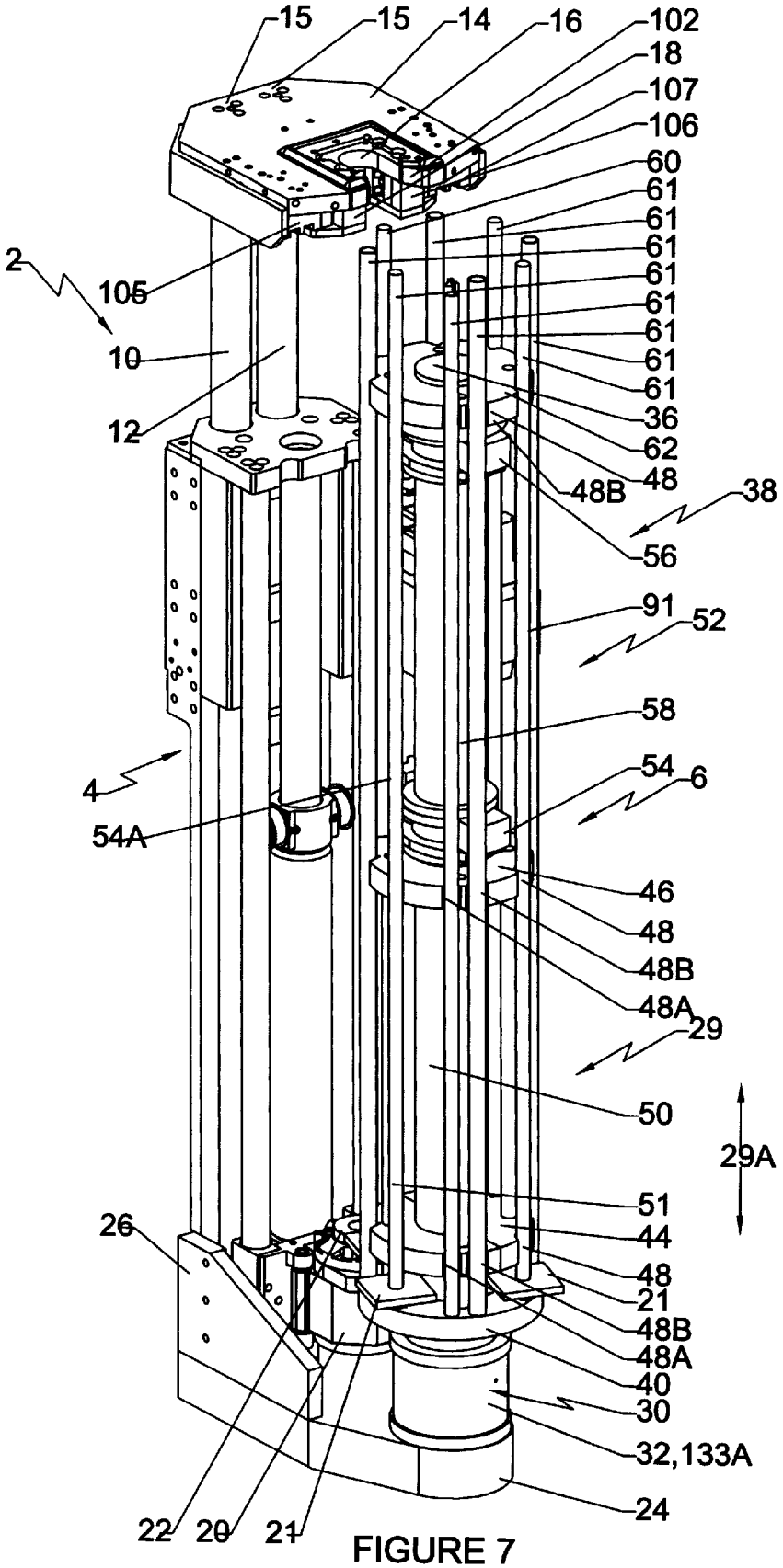
FIG. 7 illustrates a perspective view of the apparatus of FIG. 1 with drill rods, bolts and resin tubes mounted therein as viewed from a forward upper, and left side position.
Figure 8:
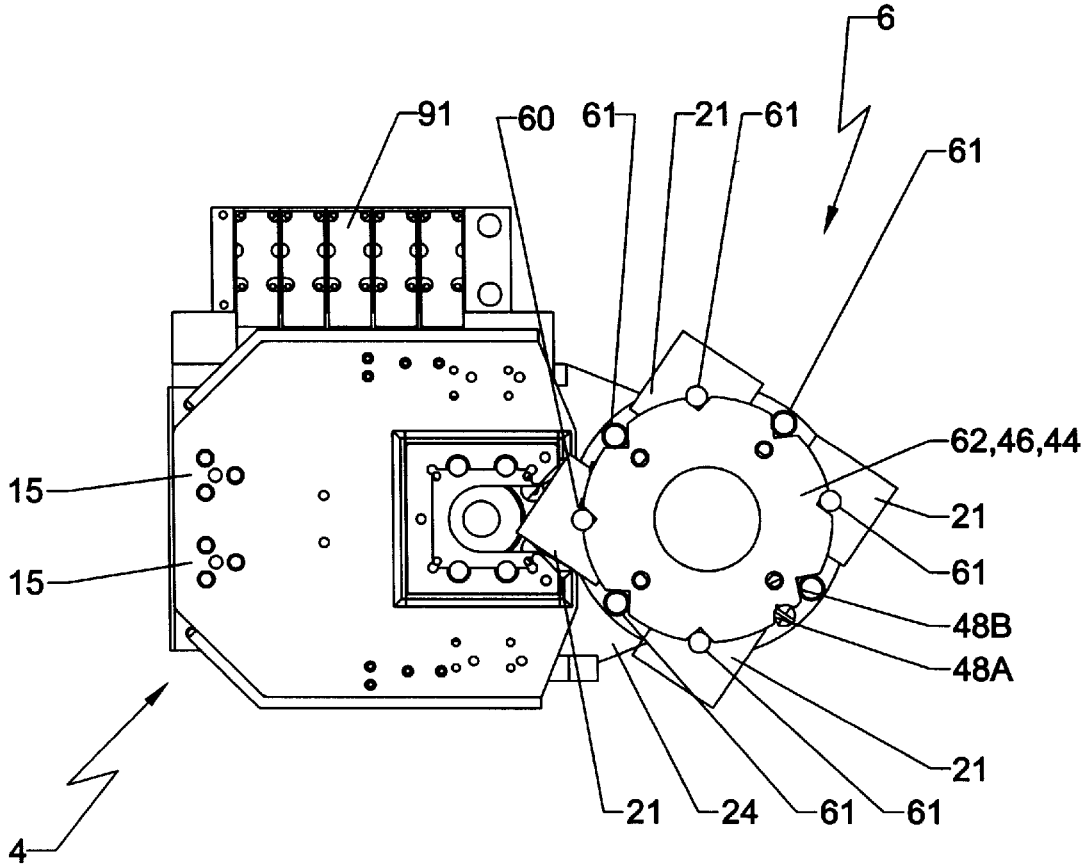
FIG. 8 illustrates a plain view of the apparatus of FIG. 7.

The roof bolting apparatus 2 is made up of two sub-assemblies. The two sub-assemblies are generally a roof bolter 4 and a carousel 6. The carousel 6 generally provides a means to hold and a store of rods 60 and 61 (see FIGS. 7 and 8) such as for example chemical anchor located in steel tubes, roof bolts and drill steel all which are to be inserted singly into the motive parts of the roof bolter 4. These rods 60 and 61 will be used for operations to be performed by the roof bolter 4 against a rock formation or other formation to be strata stabilised by tendons, roof bolts etc. The drill steels, roof bolts and chemical anchor arc identifiable in the FIGS. 7 and 8, with the roof bolts including washer plates 21, the drill rod having a drill tip and the chemical anchor tube without either. As illustrated in FIGS. 7 and 8, one of rods is identified by the numeral 60 and the others by numeral 61. Rod 60 is in the position which coincides with the location from which the rod 60 and other rods can be transported from carousel 6 to roof bolter 4.

The drilling unit or the rotary drive unit 20 of the roof bolter 4 can be of any appropriate type such as just rotary, rotary and percussive, or just percussive. A percussive type of drilling unit drills only by cyclic or repetitive percussive forces. The drilling unit can also be a rotational and percussive drilling unit which can be controlled to produce either percussive or rotational drilling or both. The drilling unit can also be of the type that only utilises rotational forces. The drilling unit or rotary drive does not need to be used just to install bolts into roofs. They could be used just to drill holes or take cores from walls, floors, faces, and ribs of mine entries or of any surface requiring strata stabilisation or to install bolts into such formations or surfaces.

The roof bolter 4 has been described in co-pending application Ser. No. 34200/97 which describes in detail the features and operation of the roof bolter 4. The roof bolter 4 is modified in some minor ways for use and inter-working with the carousel 6, from that described in Ser. No. 34200/97. These modifications and differences will be described herein. The text of co-pending application Ser. No. 34200/97, as well as its corresponding U.S. application Ser. No. 908464 filed Aug. 7, 1997 are incorporated herein by reference.

One modification to the roof bolter of Ser. No. 34200/97, which is incorporated in the roof bolter 4, is that a drive fitting 22, which is rotated by the rotational drive unit 20 has a deep drawn hexagonal chuck to receive the nut on the end of a roof bolt. The depth of the hexagonal chuck is approximately 80 mm to 90 mm, so as to allow a tail length on the roof bolt when it is installed in a formation, of approximately 80 mm. The tail length being the amount of exposed thread sitting proud of the surface of the formation, after the nut has been run up the bolt to secure a washer plate 21 to the formation surface. At the base of the hexagonal portion of the chuck is located a square drive chuck which is the sort utilised with drill steels. Drill steels have a squared off formation at their end, which allows a greater driving force to be applied to the drill steel. The squared off end is preferred as it is relatively easy to form into the end of a drill steel.

Figure 11:
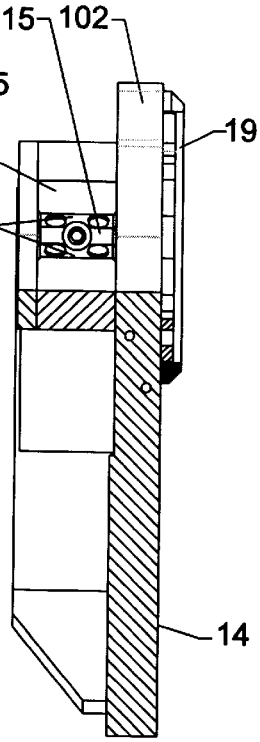
FIG. 11, illustrates a side view of the apparatus of FIG. 9.

The roof bolter 4 has a timber jack 8 at the top of which is located a top plate 14. The top plate 14 is attached to timberjack rods 10 and 12 by means of fixtures 15. The top plate 14 differs from the top plate of application Ser. No. 34200/97 by providing a U-shaped bight 16 at its forward end. The bight 16 has adjacent to it, on an under surface thereof, a mechanical centraliser 18. The purpose of the centraliser 18 is to locate one of the rods 60 transported to the roof bolter 4 along a central rotational axis which is the same axis that a rotation or drive unit 20 will rotate rod 60 around. This axis is also the axis around and along which the drive fitting 22 of the drive unit 20 rotates and translates. The centraliser 18 is described in more detail with reference to FIGS. 9 to 11.

The bight 16 illustrated in FIGS. 1 to 8 does not have sufficient width to allow passage of washer plates 21 (illustrated in FIGS. 7 and 8) which are pre-assembled onto the rods 61 which are roof bolts. For passage of washer plates 21 the bight 16 is made wider. If desired a round washer can be used which will reduce, compared to a square washer, the size that bight 16 needs to be to allow passage of the washer if the washer is rotating. The configuration of centraliser 18 and bight 16 illustrated in FIGS. 1 to 8 is able to be used in situations where there is no need to pre-assemble the washer plates 21 to the roof bolt. Such situations arise where webbing or W-straps are first secured to a mine roof or wall or other surface. Such webbing or W-straps will be able to include washer plates attached to them, so that the washer plates are placed at a predetermined spacing, with out the need for "close enough" or other inaccurate measuring to be done by mine workers. If the roof bolter 4 is operated manually an operator can place a washer plate inside the confines of walls 19, which will centre the hole through a washer plate 21 onto the rotation axis of the drive unit 20. Four permanent or rare earth magnets 23 are recessed in the top plate 14 to keep the washer plate 21 in position, until a roof bolt and nut is installed and tightened. The roof bolter 4 is either attached to a base plate 24 or alternatively the base plate 24 acts as the base plate for the roof bolter 4 and is integrally formed therewith. The base plate 24 is a ported block which provides passage for hydraulic fluid as will be described later. The ported block facility of the base plate 24 allows the carousel 6 to receive hydraulic fluid and pressure so as to provide motive power to the carousel 6. Such a system avoids the need to connect external hoses to and between the respective inlets outlets of carousel 6 and roof bolter 4.

For stability and reduction of elasticity, two gusset plates 26 and 28 are respectively secured to the right and left hand sides of the roof bolter 4 and the base plate 24. The gusset plates 26 and 28 help to ensure a relatively rigid mounting of the roof bolter 4 to the base plate 24. The gusset plates 26 and 28 will also ensure less opportunity is provided for the rotation of the roof bolter 4 relative to the base plate 24.

On the end of the base plate 24, opposite to the location of the roof bolter 4, is the carousel 6. The carousel 6 is located so that its periphery is a distance of approximately 100 mm from the centre line of rotation of the drive fitting 22 on drive unit 20.

Figure 12:
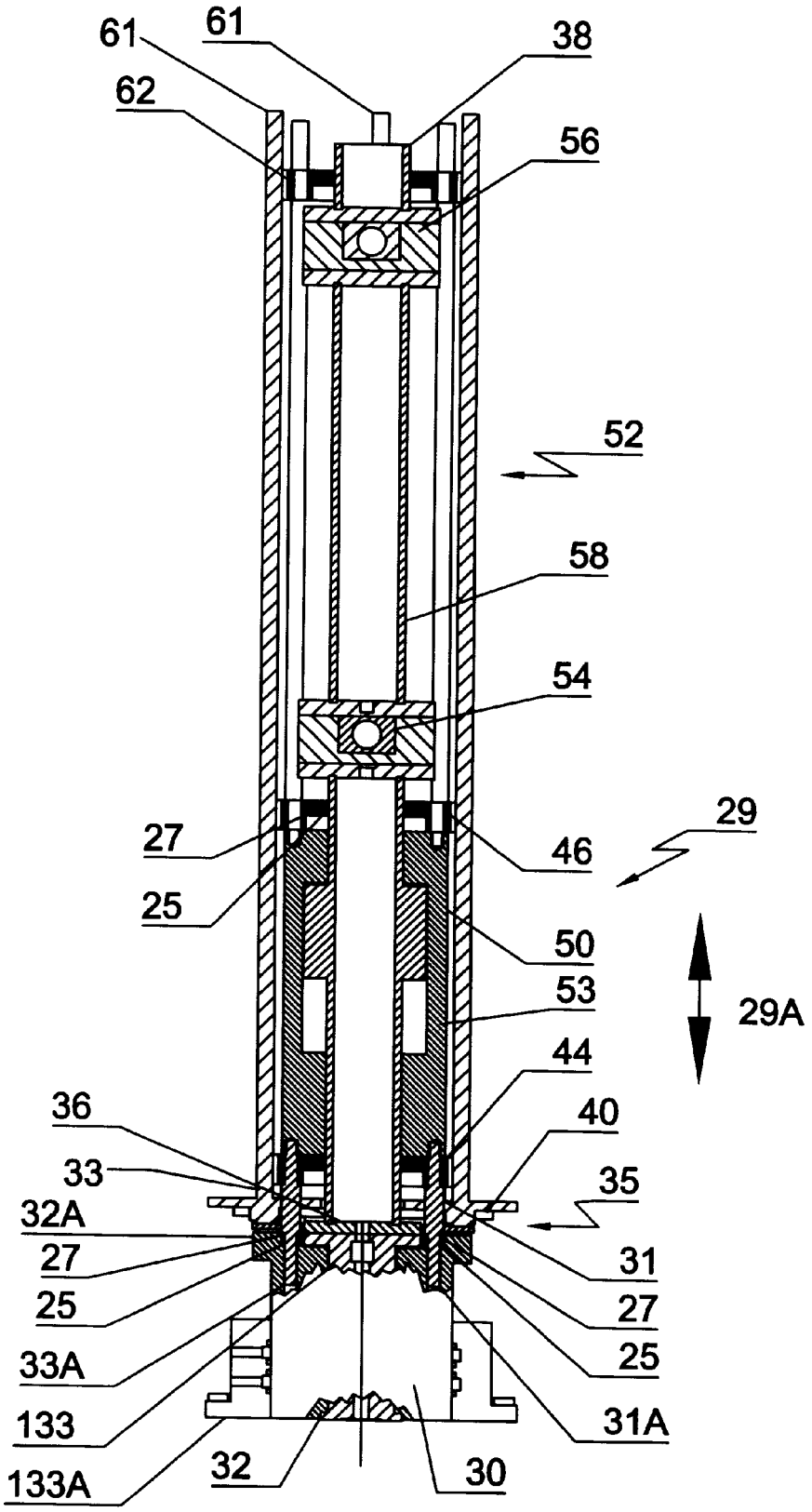
FIG. 12 illustrates a diagrammatic section through the carousel of FIGS. 1 to 7.
Figure 13:
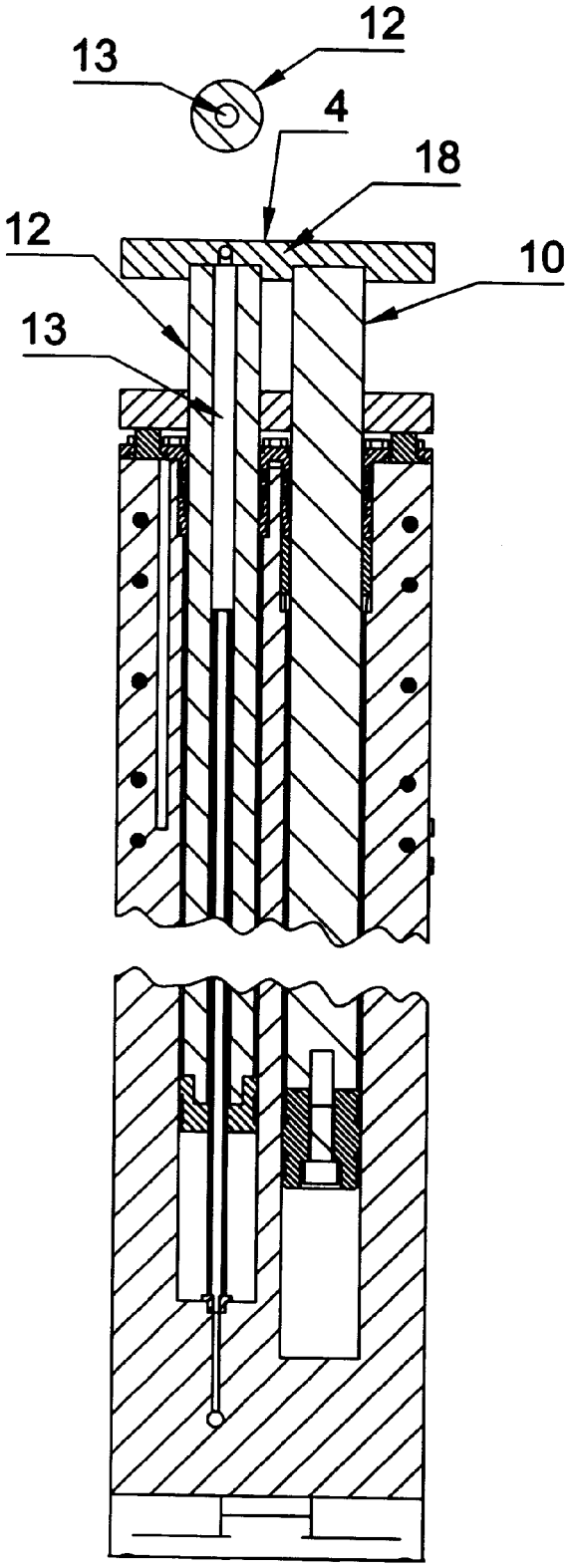
FIG. 13 illustrates in a diagrammatic illustration how the idler rod of the timber jack of FIGS. 1 to 9 can be used to deliver hydraulic fluid to the centraliser.

The carousel 6 as illustrated in FIG. 12 is powered by a rotary actuator 30. The rotary actuator can be of any suitable type with the main function being to provide rotation to the carousel 6. In order to keep the carousel 6 as compact as possible most preferably the rotary actuator 30 has a stationary central column 133, around which can revolve an annular rotation member 32. In order to provide internal porting of the rotary actuator 30, an outer stationary annular member 133A is provided to carry the porting which will deliver hydraulic pressure to the rotation member 32.

The stationary central column 133 has hydraulic connection to the passages in the ported block of the base plate 24. Thus hydraulic fluid and pressure can be transferred through the base plate 24 into the central column 133 of the rotary actuator 30 thereby powering the rotary actuator 30.

The annular rotation member 32 is the driven member of the rotary actuator 30. The central stationary column 133 of rotary actuator 30 has attached to it a stationary shaft 36 which passes through and forms part of the carousel central spindle assembly 38. The stationary shaft 36 and the stationary shaft of the rotary actuator 30 can either be integrally formed or alternatively may be secured together by conventional securing mechanisms.

Figure 14:
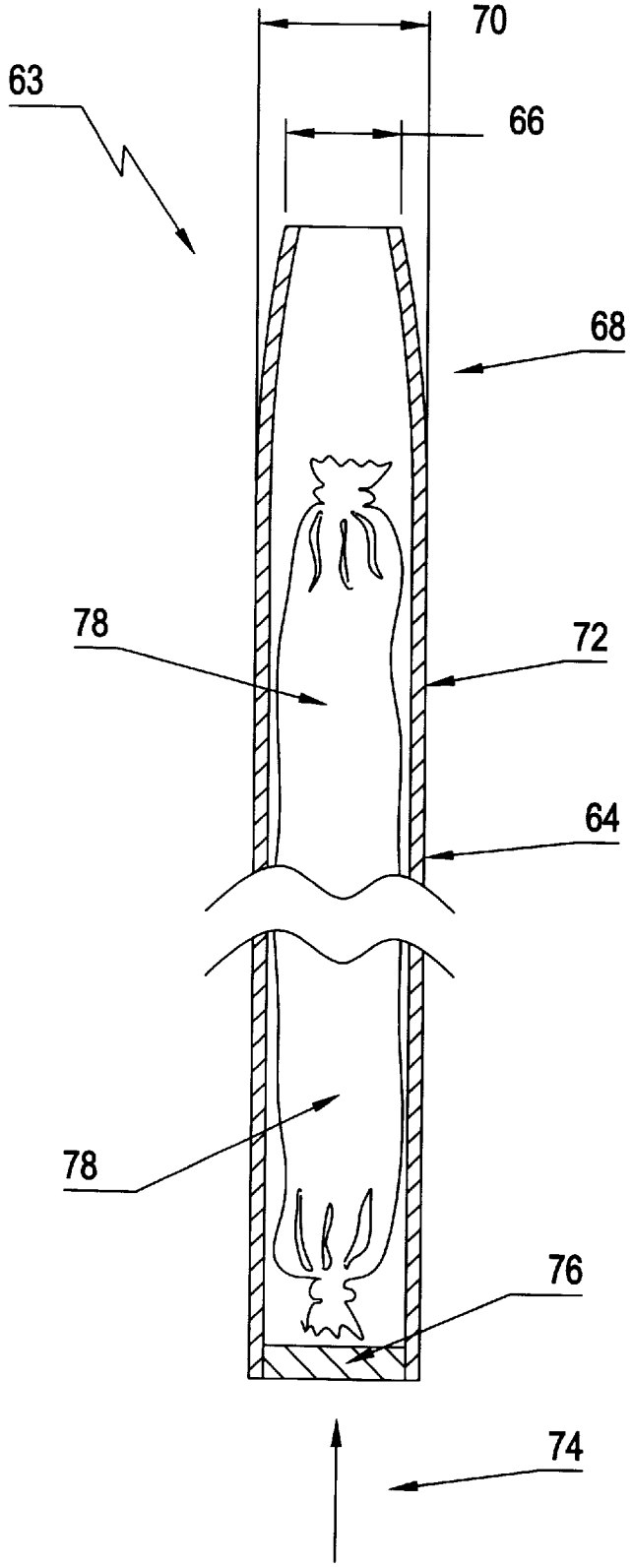
FIG. 14 illustrates a cross section through an anchor tube for use with the present invention.

Illustrated in FIG. 12 is a diagrammatic representation of the spindle assembly 38. It shows an annular platform disc 40 together with spiders 44, 46 and tubular spacer or shaft 50 which make up a spider assembly 29. If desired, as illustrated In FIGS. 1 to 8, the two spiders 44 and 46 can also be additionally or alternatively supported by four columns 51 equi-spaced around the spiders 44 and 46. These columns 51 are not essential, as an alternate support construction as illustrated in FIG. 14 could also be used. If desired the four columns 51 of FIGS. 1 to 8 could provide all the support and spacing necessary between the spiders 44 and 46, without the need to utilise the tubular spacer or shaft 50.

As illustrated in FIG. 12, the annular platform disc 40 is preferably connected via a rotatable connection 35 to the annular rotation member 32 which rotates by powers the annular platform disc 40. The rotatable connection 35 is made up of two shafts 31 and 33 which extend downward from platform disc 40. The two shafts 31 and 33 are received by two bores 33A and 31A in the annular member 32 in which shafts slide 31 and 33 and can extend from or retract into. The shafts 31 and 33 have wipers 27 and sliding seals 25 to prevent ingress of water and grit. Thus when annular member 32 rotates so will annular platform disc 40 and the rest of spider assembly 29. The connection 35 is not visible in FIGS. 1 to 8.

The rotatable connection 35 is also a slideable connection and is provided so that the platform disc 40 and the spider assembly 29 can slide from the position illustrated in FIG. 12 to a retracted position whereby the shafts 31 and 33 are as far into bores 31A and 33A as is possible. This sliding motion can be made to operate sequentially or simultaneously with the rotational movement provided by the rotary actuator 30. This sliding movement lowers or raises the annular platform disc 40, for transport or other purposes. This movement of the spider assembly 29 moves in the direction of arrows 29A by means of an internal hydraulic cylinder 53, which receives hydraulic fluid and pressure through internal ports and passages through stationary inner shaft 36, which in turn receive same from central column 133 of rotary actuator 30.

The roof jack or timber jack 8 illustrated in FIGS. 7 8 is in a partially extended position and the rods 60 and 61 located in the carousel 6 are at a similar height so that they will engage the centraliser 18. However, in a transport position the timber jack 8, the centraliser 18 and the tops of the rods 61 and 60 should be located as close to the base plate 24 as is possible to ensure compactness for transport purposes.

The rotatable and slideable connection 35 is only preferable. If it is employed, then preferably the spider assembly 29 has, at its upper most and lower most portions next to stationary shaft 36, annular wipers 27 and annular sliding seals 25 to keep the sliding surfaces free from water and grit. If the rotatable slideable connection 35 is not employed, the annular platform disc 40 can be simply secured to the annular member 32 of the rotary actuator 30.

If desired an alternative arrangement could be provided to rotatably power and raise or lower the carousel 6. In such an alternative arrangement a rotary actuator having a pinion gear can be used to engage a mating gear (not illustrated) located on a surface 32A on the annular rotation member 32. In this case the annular rotation member 32 will not be the driven member of a rotary actuator, but it will be simply a driven gear, which will revolve around the central column 133 which will act as a stationary axle. Through the stationary central column 133 the appropriate porting to can be provided, as mentioned above to power the internal hydraulic cylinder 53. This alternative is expected to require external hoses and will more than likely occupy more space than the arrangement described above in respect of FIG. 14.

The annular platform disc 40 is connected to two spiders 44 and 46. A third spider 62 is rotatably connected to the inner stationary shaft 36 and will be described in more detail later. The spiders 44, 46 and 62 are each of the same general disc shape having a series of notches 48 which are either V-shaped as illustrated in FIG. 8 or may be semi-circular or other appropriate shape if desired. The notches 48 can be equi-spaced as is illustrated for most of the notches 48 of the figures. Alternatively the notches can be positioned at various spacings or in side by side relationship as illustrated by the two notches 48A and 48B, so that for example a drill steel and a roof bolt can be located side by side, thus ensuring a faster operation of the combined carousel 6 and roof bolter 4, because the rotary actuator 30 will travel through a lesser angular distance to position a drill steel and then a roof bolt for transport to the roof bolter 4.

The notches 48 provide a locating point for the rods 61 and 60. Data concerning locations of the notches 48 are pre-programmed into an integrated controller module 91 and associated control circuitry. The pre-programming and specification of the locations of the notches 48 assists the carousel 6 in an indexed motion, so that one rod, in this ease rod 60 is positioned to a specified predetermined location for transporting to the roof bolter 4, where it will be used by the roof bolter 4 in its operation.

The spiders 44, 46 and 62 will hold the rods 60 and 61 in the notches 48 by means of permanent super or rare earth magnets. These permanent super or rare earth magnets can be recessed in the spiders 44, 46 and 60 in tubular formations closed at one end and open at the other, adjacent to the notches 48. The tubular formations have one open end, with respect to which the exposed surface of the magnet will lie adjacent or recessed, with the rest of the magnet being in and protected by the enclosed formation.

The spiders 44 and 46 are mounted on a tubular spacer or shaft 50 so that the tubular spacer or shaft 50 together with the spiders 44 and 46 will rotate around the inner stationary shaft 36 when the annular platform disc 40 is rotated by the annular member 32 of rotary actuator 30. The notches 48 in both the spiders 44 and 46 are held aligned, so that rods 60 and 61 held in the respective and corresponding notches 48 on the spiders 44 and 46 have their central longitudinal axes parallel to the rotation axis along which the drive fitting 22 will rotate and translate. This will ensure that no re-orientation or matching of orientations of the axes of the drive unit 22 with respect to the rod 60 or 61 need occur.

Figure 1:
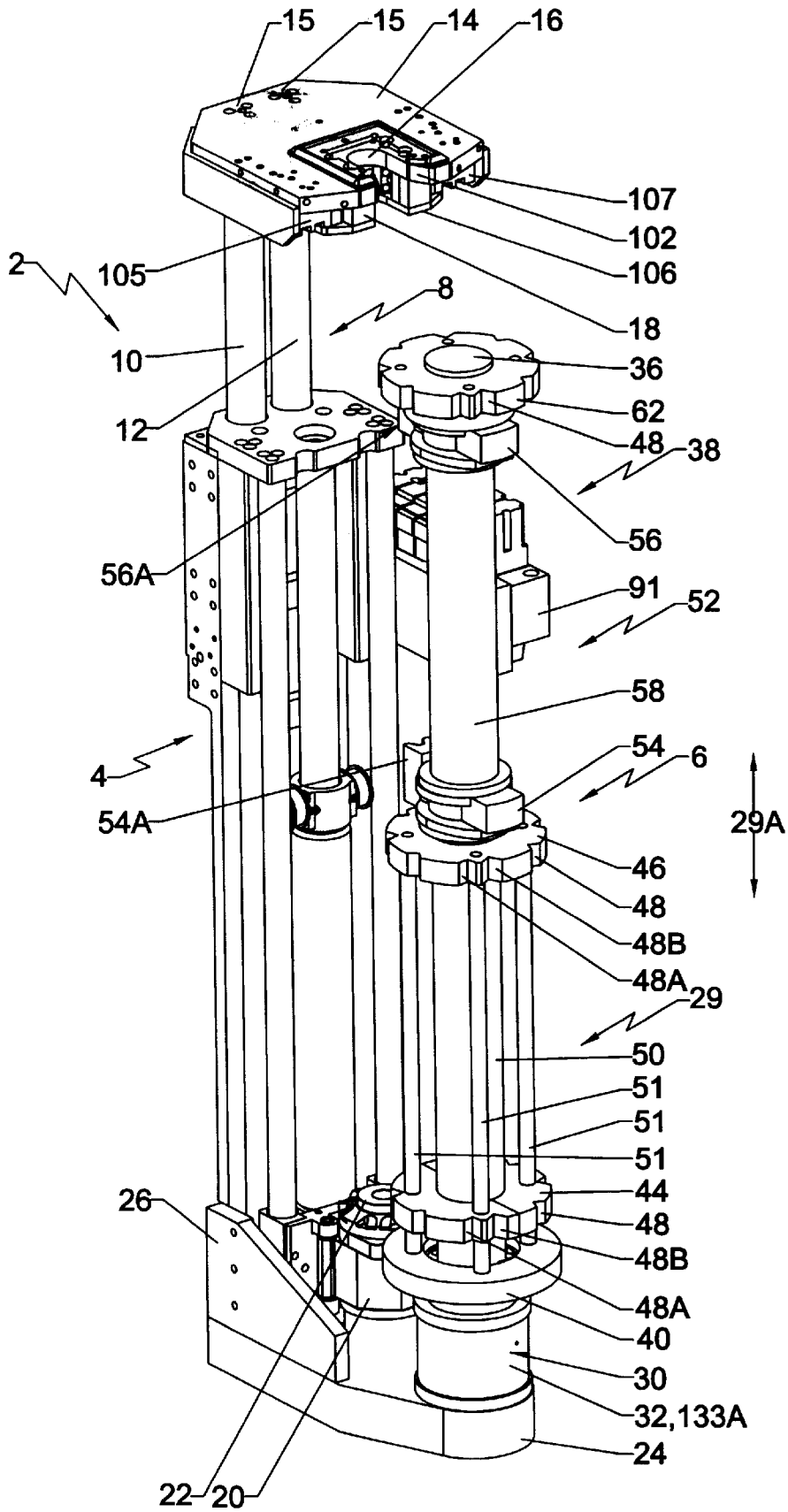
FIG. 1 illustrates a perspective view of an apparatus embodying the invention as viewed from a forward upper and left hand side position thereof.
Figure 2:
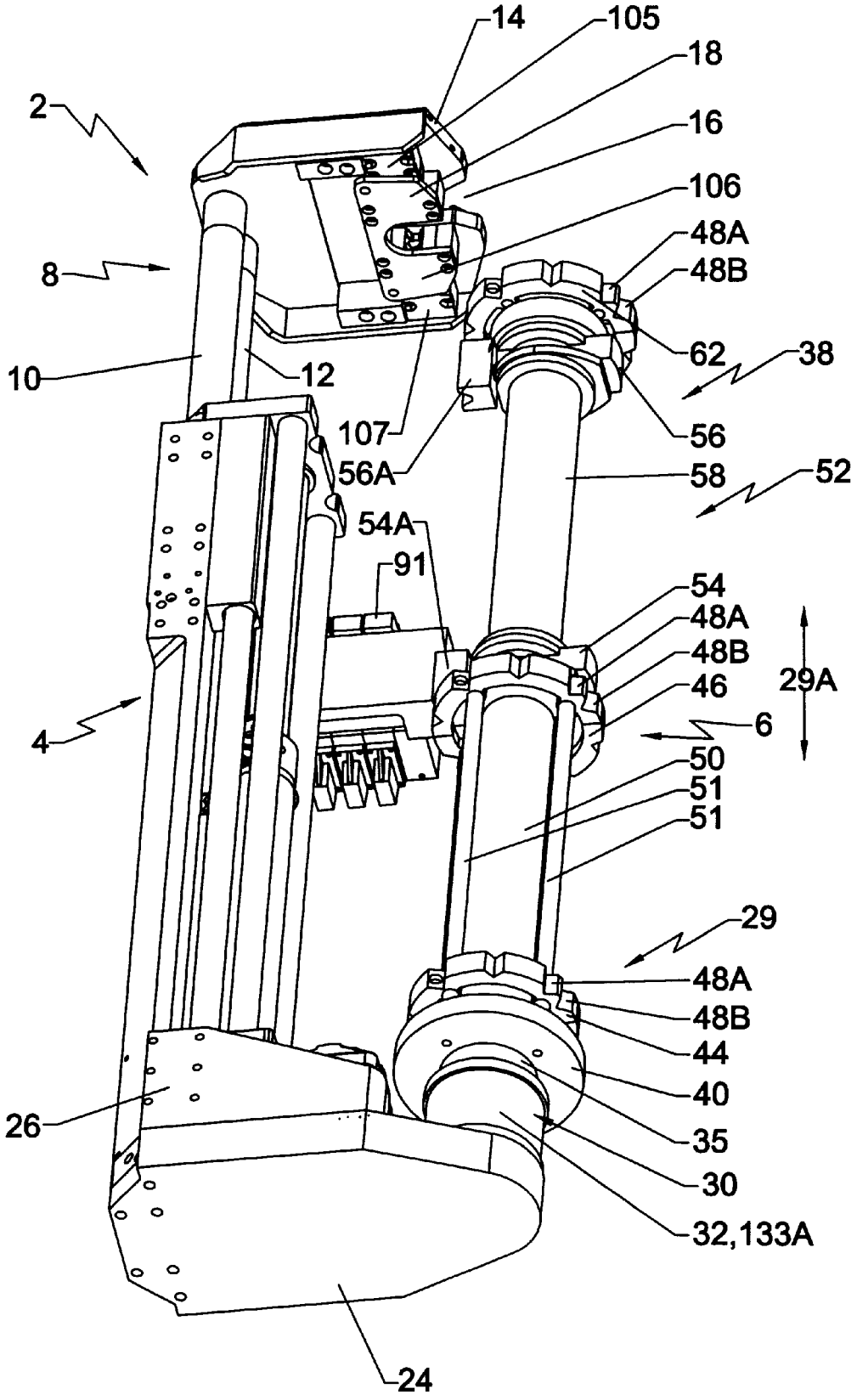
FIG. 2 illustrates a perspective view of the apparatus of FIG. 1 as viewed from a forward, underneath and left side position thereof.

The disc 40, spiders 44, 46 and tubular spacer or shaft 50 which make up the spider assembly 29 occupy generally the lower half of the spindle assembly 38. The upper half is occupied by the transfer cylinder column 52 as is best illustrated in FIGS. 1 to 8 and 12. The transfer cylinder column 52 is mounted on to the inner stationary shaft 36 so that transfer cylinders 54 and 56 which are part of the transfer cylinder column 52 are kept stationary relative to the inner stationary shaft 36 and the roof bolter 4. The transfer cylinders 54 and 56 are kept in a spaced apart relationship by means of a tubular spacer 58. The transfer cylinders 54 and 56 are best illustrated in FIGS. 1 and 2 but generally is said to comprise a single or multi-stage piston which can be hydraulically powered so as to extend out of and retract into the transfer cylinders 54 and 56. The transfer cylinders 54 and 56 are such that their pistons have an extension of over 100 mm so as to move from a position within the periphery of the carousel 6 or spiders 44,46 and 62 to a position such that a rod 60 held by the transfer cylinders 54 and 56 will have its central longitudinal axis located collinear with the axis of rotation and translation of the drive fitting 22.

When the transfer cylinders 54 and 56 are extended, the rod 60 which is illustrated in FIGS. 7 and 8 will connect to the end of the pistons of the cylinders 54 and 56. Once connected, the rod 60 will travel with the pistons of transfer cylinders 54 and 56 until such time as the top of the rod 60 is located in the appropriate location in the centraliser 18.

The pistons of the transfer cylinders 54 and 56 have ends 54A and 56A (see FIG. 1) which are generally U-shaped or U-shaped to cradle the rods 60 and 61. Preferably the shape of the ends 54A and 56A are able to accommodate different outside diameter rods 60 and 61, as does the notches 48 on spiders 44,46 and 62. In the ends 54A and 56A are situated permanent super or rare earth magnets. Preferably an external surface of the magnet is adjacent to, or recessed close to, the outer edge of the ends 54A and 56A. The magnets acts as the holding or grasping mechanism to hold the rods. The magnets can provide a relatively strong magnetic force of attraction for any steel such as drill steel or roof bolt or chemical anchor insertion tube, which may be in contact or close proximity thereto.

One of the features of the embodiment described in respect of FIGS. 1 to 8 and 12 is that the transfer cylinders 54 and 56 are contained within the confines of the spiders 62, 44 and 46. This allows for a compact construction of the carousel 6 as well as of the transfer mechanisms, in this case transfer cylinders 54 and 56.

The upper spider 62 idles on the stationary shaft 36. The upper spider 62 will rotate with the other spiders 46 and 44 when they rotate, but only if one or more rods are also located and positioned in corresponding and respective notches 48 of the three spiders 44, 46 and 62.

The centraliser 18 has a U-Shaped bight 16 of a width to allow a rod 60 or 61 to be received therein. As mentioned previously, this bight 16 is not wide enough to allow passage of the washer plate 12. Notwithstanding this the centraliser 18 is useful for rods without washer plates. The bight 16 includes an angled entry portion 102 to assist a rod 60 which may contact the portion 102 to enter into the bight 16.

Figure 9:
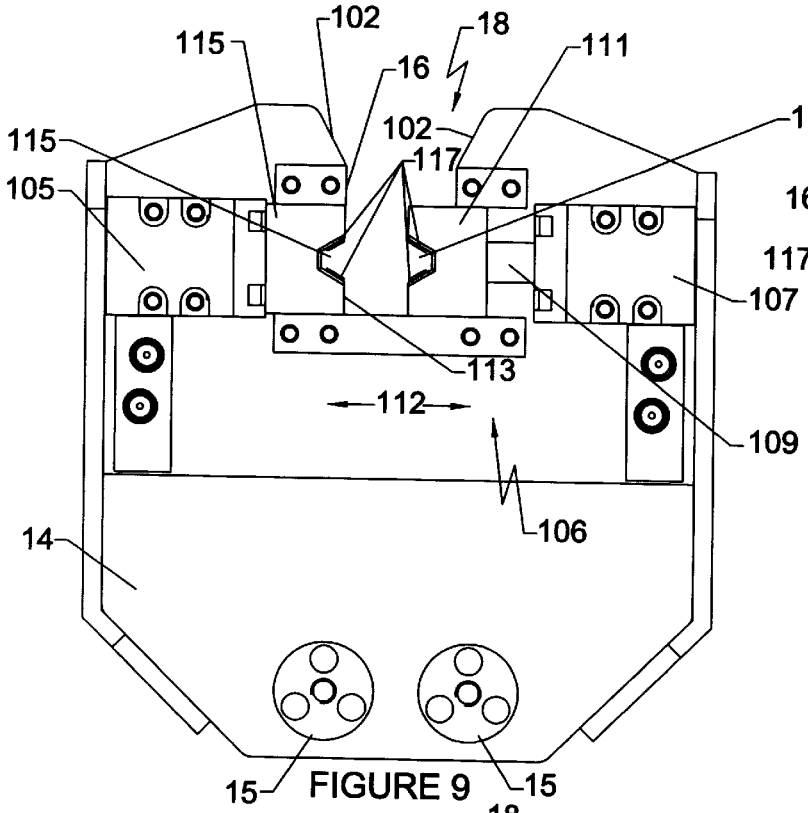
FIG. 9 illustrates an underneath plan view of a centralised for use with the apparatus of FIGS. 1 to 7.
Figure 10:
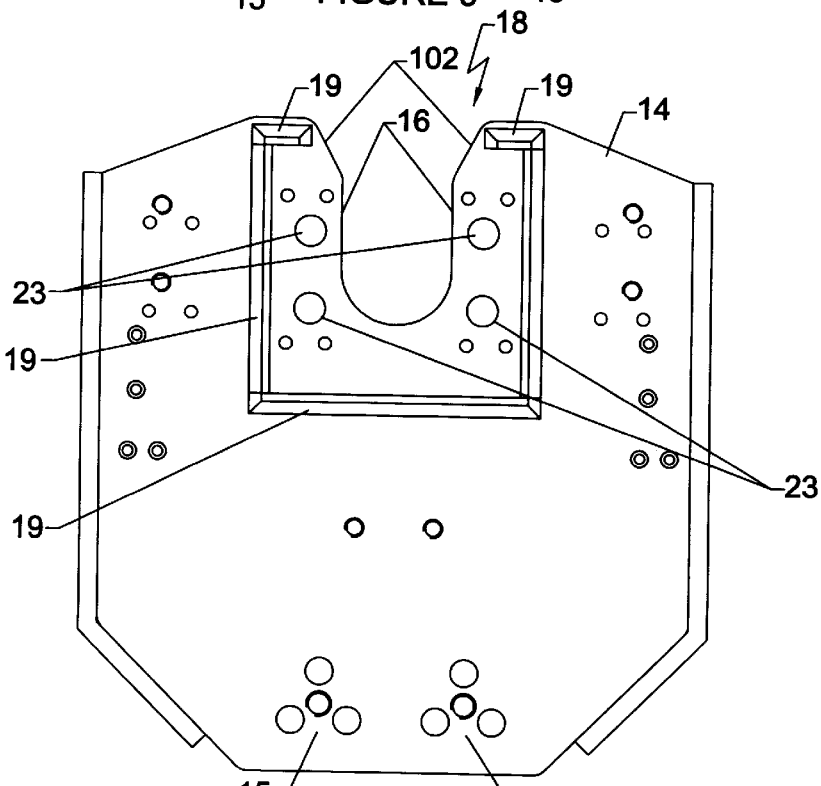
FIG. 10 illustrates plan view of the apparatus of FIG. 9.

The centraliser 18 is constructed in two levels. The first level is formed by the plate 14, and the second is formed below plate 14. The plate 14 includes the bight 16 and entry portion 102. Below the plate 104 is an operational mechanism 106 which is more clearly illustrated in FIGS. 2 and 9 to 11. The mechanism 106 includes two small opposed hydraulic cylinders 105 and 107. The hydraulic cylinders 105 and 107 extend and contract into and out of the bight 16, in the direction of arrows 112. On the ends of each of the pistons 109 or rods of the two opposed hydraulic cylinders 105 and 107 is a yoke shaped member 111 having a bight 115 on its forward most edge 113. The bight 115 is illustrated in FIG. 9 as being a three sided cuneiform shape. However, it may also be semicircular or rounded. The bight 115 will form a hole when there is contact of the forward most edges 113 of the two yoke shaped members 111 on the two opposing hydraulic cylinders 105 and 107. The 'hole' formed thereby, will surround the rod 60 once it enters into the bight 16. The size of the 'hole' is preferably only marginally larger than the outside diameter of the rod 60 or 61, this way the rod 60 or 61 is kept relatively close to the rotation and translation axis of the drive fitting 22 of the rotational unit 20.

The central axis of the 'hole', when it is formed by the forward most edges 113 of the yoke shaped members 111 on the two opposing pistons of hydraulic cylinders 105 and 107, will be substantially collinear with the axis of rotation of the drive fitting 22. If desired the forward most edges 113 of the yoke members 111 can have angled lead-in 117 surfaces (FIG. 9), so that if it were the case that the rod 60 or 61 were not positioned on the central rotation axis of the drive fitting 22, the angled lead-in surfaces 117 will engage the rod 60 or 61 thereby shifting the position of the rod 60 so that its central longitudinal axis will be substantially collinear with the axis of rotation of the drive fitting 22.

The centraliser 18 is powered by means of hydraulic fluid and pressure which is supplied to it via one of the timberjack rods 10 or 12 as is illustrated diagrammatically in FIG. 15.

Preferably the timber jack rods are constructed from Nitro-steel rods and in the case of the rod 12, by a hollow or drilled nitro-steel rod. In co-pending application Ser. No. 34200/97 the timber jack is powered for translation, extensile and or retractile, by means of one of its rods 10 or 12. The other rod 12 or 10 is an idler rod. The centraliser 18 receives motive power by hydraulic fluid and pressure which travels up through ports 13 drilled into the idler rod of the timer jack 8, in this case the idler rod being rod 12. Such internal porting 13 and supply mechanism provides a source of hydraulic fluid and power which negates the use of hoses which can break or get caught up and damaged during use. Hoses are also responsible for the much of the down time of mine equipment and the present invention ensures that a minimum number of hoses are utilised.

The centraliser 18 is controlled by the integrated control module 91 and associated control circuitry. The opposed hydraulic cylinders 105 and 107 are activated by the integrated control module 91 when the transfer cylinder 56 and or 54 has reached its appropriate extension to locate the rod 60 so that the rod 60 has its central longitudinal axis located collinear with the axis of rotation and translation of the drive fitting 22.

The appropriate extension is determined by means of accurate or sensitive location sensors which are integral with or associated with the transfer cylinders 54 and 56. By means of such sensors, once the transfer cylinders have extended to a predetermined length, the integrated control module 91 then opens and or closes appropriate valves, to power the cylinders 105 and 107 of centraliser 18 there by allowing the yoke members 111 to surround the rod 60.

Once the transfer cylinders 54 and 56 have delivered the rod 60 to the centraliser 18 and into the axis of rotation and translation of drive fitting 22, the permanent magnets attractive forces needs to be broken, but the magnets are not able to be switched off. Thus to break the contact between the permanent magnets and the rod 60, cooperation is received from both the drive fitting 22 and the centraliser 18. To break the magnetic connection between the permanent magnets of the transfer cylinders 54 and 56 and the rod 60 that they are holding, the rotation unit 20 is moved upwards with its drive fitting 22, so that the drive fitting 22 engages the hexagonal end or lower end of the rod 60 held by the permanent magnets of the ends 54A and 56A of transfer cylinders 54 and 56. At the same time the rod 60 is also surrounded by the yoke member 111 in the centraliser 18. The hexagonal end may be a hexagonal nut threaded on to the end of roof bolt or the hexagonal or square end of a drill steel or the rounded end of a chemical anchor tube (which may instead be a hexagonal end to engage the hexagonal socket in the drive fitting 22).

As the rod 60 is held by the permanent magnets at the ends 54A and 56A of the pistons of the transfer cylinders 54 and 56, the rod 60 will tend not to rotate due to the magnetic forces. Thus as the drive fitting 22 is moving towards the closest (lowest) end of the rod 60, the drive fitting 22 can be made to simultaneously rotate at a relatively slow pace. This will allow engagement of the hexagonal end of the rod 60 into the hexagonal socket of the drive fitting 22.

Once this engagement has occurred, both the base and top of the rod 60 are respectively secured inside the drive fitting 22 and centraliser 18 of the roof bolter 4. The piston and permanent magnets of the transfer cylinders 54 and 56 can then be retracted by hydraulic means which will provide sufficient force to overcome the forces of magnetic attraction between the rod 60 and the permanent magnets. This will leave the rod 60 in-situ in the roof bolter 4 so that its central longitudinal axis is co-linear or concentric with the axis of rotation and translation of the drive fitting 22.

Once the transfer cylinders 54 and 56 have fully retracted, the rotational unit 20 and the roof bolter 4 operate as required to either drill an aperture in a formation which requires its strata to be stabilised, or secure a roof bolt into the strata. By means of the chemical anchor tube the roof bolter 4 will be able to also insert the chemical anchor into a pre-drilled bore in the strata.

As the drill steel and the tube (which may formerly have or carried chemical anchor) are reusable, then the both of these rods will have to be removed from the roof bolter 4 and returned to the carousel 6 for storage, and reuse later or disposal. Returning the reusable rods to the carousel 6 is performed as follows.

When the rotational unit 20 is retracted to the position at which it received or made contact with the lower end of the rod 60, then at this point, the transfer cylinders 54 and 56 extend the pistons and permanent magnets towards the rod 60. Once contact is made, extension of the pistons of transfer cylinders 54 and 56 ceases. The cessation of extension of the transfer cylinders 54 and 56 is determined by means of the location sensors which are associated with the transfer cylinders 54 and 56. The location sensors also trigger the integrated control module 91 to open the centraliser 18 by retracting the hydraulic cylinders 105 and 107 in the centraliser 18, and simultaneously fully retracting the drive fitting 22 by moving it further downward to disconnect it from the lower end of the rod 60. At which point the rod 60 can be retracted with the transfer cylinders 54 and 56 and delivered back to the specific notch 48 from which it was first taken. Alternatively the carousel 60 can replace it to another empty notch 48.

The notch 48 to which the rod 60 will return must be determined prior to the transfer cylinders 54 and 56 extending their pistons and magnets past the periphery of the carousel 6 or spiders 44, 46 and 62. This is because once past that periphery, the rotary actuator could not rotate due to rods 61 held on the carousel 6 potentially colliding with the extended transfer cylinders 54 and 56.

It is preferred that the integrated control module 91 is such that it is either pre-programmed so that it will not power or rotate the rotary actuator 30 when there is a possibility of collision with the transfer cylinders 54 and by any rods 61 or 60 on the carousel 6. Alternatively, a retractable pawl or solenoid can operate to lock the rotary actuator 30, to prevent it moving when the transfer cylinders 54 and 56 extend.

The chemical anchor insertion tube 63 is constructed as in FIG. 4. The insertion tube 63 comprises a round or hexagonal open ended steel tube 64, which is preferably plugged at one end by a plug 76. The steel tube 64 can have an outside diameter 66 tapers at its open end 68 to an outside diameter 70. This taper will allow insertion of the open end 68 into the pre-drilled hole. This taper also allows location of open end 68 into the pre-drilled hole as well as preventing entry of tube 64 into the pre-drilled hole because outside diameter 66 is greater than the outside diameter of the pre-drilled hole. Alternatively the inside diameter 70 can be of a size larger than the outside diameter of the drilled hole so that the open end 68 will abut the formation in which the pre-drilled hole has been drilled.

Once the open end 68 has been inserted into the pre-drilled hole in the rock formation, a force can be applied in the direction of arrow 74 against a plug 76. Alternatively, if the upper end of the steel tube 64 is abutted against the rock formation so that the outside diameter of the pre-drilled hole is inside of the inside diameter of the cylindrical side wall 72, a force can then be applied in the direction of arrow 74 against a plug 76.

The force in the direction of arrow 74 can be applied by a variety of means by the roof bolter 4. When a force is applied against the plug 76 in the direction of arrow 74, the separate bags 78 of chemical anchor compound will move into the pre-drilled hole in the rock formation. The bags 78 (otherwise known as sausages) of compound stay in their bags once they enter the pre-drilled hole. As the bags 78 are being pushed into the pre-drilled hole, they remain in position inside the pre-drilled hole even the force or pressure exerted on plug 76 has been removed. This is because they expand against the side walls of the pre-drilled hole.

The plug 76 can either terminate its motion at the open end 68 and thus remain within the confines of the steel tube 64 or alternatively the plug 76 can be ejected into the pre-drilled hole. By the plug 76 being of foam, sponge or other suitable material it can be crushed or pulverised or pushed to the end of the pre-drilled hole when a roof bolt is inserted into the pre-drilled hole to mix the compounds in the pre-drilled hole to begin the setting of the chemical anchor.

The foam plug 76 can be formed in-situ before the sausage 78 of compound are placed into the tube 64 or alternatively it can be positioned after. Preferably the plug 76 applies only sufficient force against the internal side walls of the steel tube 64 as is sufficient to support the weight of the sausage 78 when the rod is in a vertical orientation as it may be, once installed into carousel 6.

The plug 76 can be pushed by a force in the direction of arrow 74 by one of a variety of means. One is to provide a rubber based gasket in the base of the socket of the drive fitting 22 with an aperture therethrough. The aperture can lead to a water jet or pump means or other source of pressurised fluid. Such pump is always provided with drilling and roof bolting equipment as water is used for both the lubrication and assistance in clearing away debris from the drilled hole. Thus there is generally a ready source of water under pressure. While a rubber based gasket is mentioned above, an alternative could be a metal to metal seal between the closed end of the steel tube 64 and either the hexagonal chuck or the square drive chuck of the drive fitting 22.

Once the drive fitting 22 compresses the tube 64 against the rock formation, (or it may be gripped by yoke members 111 against which a portion of the steel tube 64 will be compressed) the end of the tube 64 in the drive fitting 22 will be sealed relative to the drive fitting 22 by a gasket or a metal to metal seal. Once sealed, water pressure can be applied in the direction of arrow 74 to the plug 76, thereby expelling the contents being the sausages of compound 78 into the pre-drilled hole. Other mechanisms can include a piston and/or rod to push against the plug 76 by hydraulic or mechanical means or alternatively by utilising a cable which by virtue of the confines of the internal walls of the tube 64 can push effectively along the length of the steel tube 74.

If the feature and facility of the retraction of the platform 40 and the two spiders 44 and 46 is provided so as to move them downwards for the purposes of transportation and compactness, the rods 60 and 61 will be moved down as well. However, the spider 62 will remain stationary. In this case the permanent magnets in respective spiders 44 and 46 will provide together, twice as much magnetic attractive force by comparison to the corresponding magnets in spider 62 alone, on each individual rod. Thus when spiders 44 and 46 together with the annular platform disk 40 move downwards towards the base 24, the forces from the magnets on spiders 44 and 46 will overcome the forces from magnets in spider 62 thus allowing a sliding motion of the rods relative to the spider 62.

The rotary actuator 30 has formed therein a rotary sensing mechanism such as a rotary position switch or a transducer or like apparatus so that the rotary position of the rotary actuator is able to be interrogated or known by the integrated control module 91 or other control circuity. This then means the position of the spiders 44, 46 and 62 and the notches 48 therein, relative to the unloading position of any one particular rod (which is generally indicated by the position of the rod 60) is also known. Thus by automatically controlling the rotary actuator 30, any particular rod can be inserted into the roof bolter 4 for drilling or roof bolting or other purposes.

The above described embodiments disclose the use of permanent super or rare earth magnets with both the ends 54A and 56A of the transfer cylinders 54 and 56, as well as in association with each of the notches 48 on respective spiders 44,46 and 62. The use of permanent super or rare earth magnets is preferred because they are able to generate or apply a stronger magnetic force of attraction for a given size by comparison to electro magnets or standard types of magnetic material. This allows the ends 54A and 56A and the notches 48 to be relatively compact, than would otherwise be required, in order to provide a magnitude of magnetic force of attraction necessary to support the weight of a rod.

If desired, the ends 54A and 56A and the formations adjacent to the notches 48 can be modified to provide a greater surface area, in order to provide for the location of electro-magnets or standard magnetic material. By providing additional surface area for magnetic material can result in sufficient magnetic force of attraction to support the weight of the rods such as will be used with the apparatus described above.

As an example, the surface area of the ends 54A and 56A can be modified by substituting the separate two ends with one relatively long U or V shaped cradle, which extends between two pistons 54 and 56. Due to its length the single cradle will have a significantly greater surface area by comparison to the two ends 54A and 56A. The one relatively long cradle will have approximately the same profile as ends 54A and 56A illustrated in FIG. 5. This long cradle can connect to both of the ends of the pistons of transfer cylinders 54 and 56 to which the ends 54A and 56A are currently illustrated as being connected.

If the magnetic force provided by the spiders 44, 46 and 62 needs to be encased, the axial width or the thickness of the spiders 44, 46 and 62 can be increased to provide greater surface area for magnetic material. By increasing this dimension, will provide a greater surface area for magnetic material and in this way a greater level of magnetic force of attraction can be extracted from electro-magnets or standard permanent magnets.

Another option in respect of the spiders 44 and 46, to increase the surface area for magnetic material without an increase in the size of the spiders and other equipment, is to form one spider from a hollow cylinder (to keep weight down) having a top and bottom closed end being of the shape of the spiders 44 and 46 ("the cylinder"). Longitudinally down the circumferential surface of the cylinder, linking what would have otherwise been the notches 48, is a series of constant cross section V shaped grooves, which can be lined along both sides of their whole lengths with magnetic material if desired.

Another alternative is to simply install V shaped channels linking respective aligned notches 48 on spiders 44 and 46 (such as notch 48A on spider 44 with notch 48A on spider 46; or notch 48B on spider 44 with notch 48B on spider 46). Then, without a great increase in weight (which the cylinder may add) the same result could be achieved.

In many circumstances the use of electro-magnets will require electricity supply and constant powering for simplicity, or switchable powering. Switchable powering will be provided if more complicated control systems are otherwise beneficial to the end product. However, there may in some countries be regulations which may bar the use of such electro-magnets, because of the need to keep them electrically powered. In the case of roof bolters and drilling apparatus, water is generally cascading over the units in which case difficulties with short circuiting may arise. However, this is not to say that systems and apparatus could be developed which will overcome these difficulties.

In the above description, wherever hydraulic cylinders or rotary actuators are mentioned these are generally lubricated by means of the hydraulic fluid which is pressurised and also produces movement of the cylinders. All moveable components, where possible, include appropriately shaped wipers and seals as described above in order to limit, reduce and hopefully eliminate wear problems. Such wear problems generally arise from the deluging of the apparatus and components with water which invariably includes grit, rock particles and other wear accelerant.

It will be understood that the invention disclosed and defined herein extends to all alternative combinations of two or more of the individual features mentioned or evident from the text or drawings. All of these different combinations constitute various alternative aspects of the invention.

The foregoing discloses one embodiment of the present invention and modifications by those skilled in the art may be made thereto without departing from the scope of the present invention.

What is claimed is:

1. A rod storage and transport apparatus comprising a roof bolter including a tool, said apparatus including:

a rotatable holding means adjacent said tool and adapted to hold a plurality of rods therein, an extending and retracting transport means cooperating with said holding means to move one rod at a time between said holding means and said tool, so that said tool can use said one rod to perform a mine operation, said holding means having a generally elongated shape and being able to rotate about a longitudinal axis of said shape so as to position said one rod held by said holding means adjacent said transport means, so that said transport means can transport said one rod to said tool, or position said holding means to receive a rod transported by said transport means from said tool;

said transport means when fully retracted being substantially within a cylinder generated by the rotation of one of said rods about said longitudinal axis of said holding means.

2. An apparatus as claimed in claim 1, wherein said holding means is made up of two annular elements held spaced apart and rotatably mounted on a shaft.

3. An apparatus as claimed in claim 2, wherein said annular shaped elements have circumferentially located notches to receive a respective portion of said rods, said notches including a magnetic means associated therewith to hold said rod in said holding means.

4. An apparatus as claimed in claim 1, wherein said transport means includes at least one extendible arm which can extend away from said holding means to transport said rod away from said holding means.

5. An apparatus as claimed in claim 1, wherein said holding means locates said rod as close to said transport means as is possible to minimise the amount of volume occupied by said holdings means and said transport means in combination.

6. As apparatus as claimed in claim 1, wherein said transport means is two hydraulic cylinders with magnetic means mounted to ends of pistons of said two hydraulic cylinders, said two hydraulic cylinders being held spaced apart from each other to engage one of said rods at two spaced points of contact.

7. An apparatus as claimed in claim 1, wherein said transport means includes a connection means to connect said rod to said transport means by magnetic forces of attraction.

8. An apparatus as claimed in claim 7, wherein said transport means is able to overcome said magnetic forces of attraction between said rod and said transport means to leave said rod in said tool.

9. An apparatus as claimed in claim 1, wherein said holding means holds said rods around said transport means so that said rods have their longitudinal axes located parallel to a central longitudinal axis of said holding means.

10. An apparatus as claimed in claim 1, wherein said holding means is able to move said rods relative to said tool in a direction parallel to the longitudinal axis of said rods.

11. An apparatus as claimed in claim 1, wherein said holding means holds said rods by magnetic forces of attraction.

12. An apparatus as claimed in claim 1, wherein said holding means has a series of locators to hold said rods in respective predetermined locations on said holding means.

13. An apparatus as claimed in claim 1, wherein said holding means includes at least two generally annular disc shaped elements spaced apart and located to hold said rods at least two circumferentially spaced locations.

14. An apparatus as claimed in claim 1, wherein said holding means includes at least two generally annular disc shaped elements spaced apart and located to hold said rods at least two axially spaced locations.

15. An apparatus as claimed in claim 1, wherein said holding means holds said rods, and said transport means transports said rod so that each said rods at all times has an orientation which is parallel to an axis of rotation of said tool, which axis of rotation each said rod will be rotated about or translated along, or both by said tool.

16. An apparatus as claimed in claim 1, wherein said holding means is a carousel assembly which is associated with said tool, said tool being a rotational drive unit associated with a feed carrier and feed frame of a drilling or roof bolting apparatus.

17. An apparatus as claimed in claim 16, including at least one ported block to connect said carousel to said tool whereby the supply of all hydraulic fluid and pressure to said apparatus for the purposes of power and lubrication flows within the confines of the structure of said carousel, said ported block and said tool.

18. An apparatus as claimed in claim 1, wherein said holding means achieves its holding function, and said transport means is able to hold said rods, by means of a permanent rare earth magnet.

19. An apparatus as claimed in claim 1, including a rotary position sensor so that the location of a rod held by said holding means can be determined by a control means.

20. An apparatus as claimed in claim 1, wherein said holding means includes an annular shaped element which has at least one shaped notch to receive at least one of said plurality of rods.

21. An apparatus as claimed in claim 1, wherein said holding means is translatable in the direction of its longitudinal axis of rotation.

22. An apparatus as claimed in claim 1, wherein said holding means achieves its holding function, and said transport means is able to hold said rods, by means of a permanent rare earth magnet.

23. A rod storage and transport apparatus comprising a roof bolter including a tool, said apparatus including:

a rotatable holding means adjacent said tool and adapted to hold a plurality of rods therein, an extending and retracting transport means cooperating with said holding means to move one rod at a time between said holding means and said tool, so that said tool can use said one rod to perform a mine operation, wherein said transport means includes a connection means to connect said one rod to said transport means by magnetic forces of attraction, and wherein said transport means disconnects from said one rod by said one rod being held by said tool and said transport means moving towards said holding means with force to overcome said magnetic forces of attraction, said holding means having a generally elongated shape and being able to rotate about a longitudinal axis of said shape so as to position said one rod held by said holding means adjacent said transport means, so that said transport means can transport said one rod to said tool, or position said holding means to receive a rod transported by said transport means from said tool;

said transport means when fully retracted being substantially within a cylinder generated by the rotation of one of said rods about said longitudinal axis of said holding means.

24. A rod storage and transport apparatus comprising a roof bolter including a tool, said apparatus including:

a rotatable holding means adjacent said tool and adapted to hold a plurality of rods therein, an extending and retracting transport means cooperating with said holding means to move one rod at a time between said holding means and said tool, so that said tool can use said one rod to perform a mine operation, said holding means having a generally elongated shape and being able to rotate about a longitudinal axis of said shape so as to position said one rod held by said holding means adjacent said transport means, so that said transport means can transport said one rod to said tool, or position said holding means to receive a rod transported by said transport means from said tool;

said holding means including a first shaft to which is secured said transport means, said first shaft being stationary relative to said tool; and a second shaft of tubular construction being coaxial with said first shaft, said second shaft being rotatable relative to said first shaft and said tool, said second shaft having mounted thereon at least one holding means to receive said rods, said transport means when fully retracted being substantially within a cylinder generated by the rotation of one of said rods about said longitudinal axis of said holding means.

25. An apparatus as claimed in claim 24 wherein said transport means is secured to said first shaft.

26. An apparatus as claimed in claim 24, wherein said holding means is located at one end of said first shaft and said transport means is located at a second end of said first shaft.

* * * * *